US006257220B1

(12) United States Patent
McPherson et al.

(10) Patent No.: US 6,257,220 B1
(45) Date of Patent: Jul. 10, 2001

(54) BOW HANDLE DAMPER

(75) Inventors: Mathew A. McPherson, Norwalk; Gary L. Simonds, West Salem, both of WI (US)

(73) Assignee: Mathew McPherson, Norwalk, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/441,827

(22) Filed: Nov. 17, 1999

(51) Int. Cl.[7] ..... F41B 5/20
(52) U.S. Cl. ..... 124/89; 124/23.1
(58) Field of Search ..... 124/86, 89; 267/136

(56) References Cited

U.S. PATENT DOCUMENTS

| | | | | |
|---|---|---|---|---|
| 3,416,508 | | 12/1968 | Thompson | 124/89 |
| 3,670,712 | * | 6/1972 | Izuta | 124/89 |
| 3,757,761 | * | 9/1973 | Izuta | 127/89 X |
| 4,556,042 | * | 12/1985 | Izuta | 124/89 |
| 5,016,602 | | 5/1991 | Mizek | 124/89 |
| 5,362,046 | | 11/1994 | Sims | 473/300 |
| 5,411,009 | | 5/1995 | Thompson et al. | 124/89 |
| 5,595,168 | | 1/1997 | Martin | 124/89 |
| 5,762,060 | | 6/1998 | Larson | 124/88 |
| 5,937,843 | * | 8/1999 | Troncosco | 124/89 |

* cited by examiner

*Primary Examiner*—John A. Ricci
(74) *Attorney, Agent, or Firm*—Vidas, Arrett & Steinkraus, P.A.

(57) ABSTRACT

A dampening device for an archery bow, the dampening device absorbing vibrational energy as the limbs of the bow return to a rest position from a drawn position, the dampening device comprising at least one counterweight mounted to a resilient member. The resilient member mounted to a dampening device mounting region located on the handle, riser or limbs of the bow.

17 Claims, 5 Drawing Sheets

BOW HANDLE DAMPER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to archery bows and accessories thereof, and more particularly to a damping device or devices to be incorporated into a bow handle to absorb excess energy thereby reducing hand shock, noise and bow vibration.

Most everyone is familiar with the archery bow and arrow. The bow is a rather simple mechanical device used to store energy derived from the archer during the drawing of the bow and then when the archer looses the bow string the bows energy is rapidly released. The greater portion of this energy goes into the launching of the arrow and most of the remainder finds its way back into the bow with the excess resulting in noise or simply lost in the transfer process. Some of the energy that goes back into the bow returns it to its original undrawn state but much of it goes into moving various bow components resulting in bow hand shock and system vibrations.

Over the years archery manufactures have attempted to make the bow more efficient and in some ways they have succeeded. The compound bow is an example of the modem manufactures success in being able to increase the amount of energy that a bow can store, some modem compound bows store almost 50% more energy per peak pound of draw weight as did the longbows of years past. The basic premise being that the more energy stored the more energy one has available to launch the arrow and the result will be greater and greater arrow launch velocities. To some extent this has become true and arrow initial velocities for bow hunters have increased over the last couple of decades. Along with bows that are capable of storing energy more efficiently, the quest for higher arrow velocities has been further augmented by the fact that lighter mass weight arrows have greater launch velocities than do heavier mass weight arrows. Arrow manufactures in the last two decades have taken advantage of the availability of higher strength materials and made lighter and lighter mass weight arrows available.

The result is that today's bows are storing more energy and are being used to launch lighter and lighter mass weight arrows. The problem arises from the fact that the amount of energy that a given bow can transfer to an arrow is directly proportional to the mass weight of the arrow being shot. The overall mechanical efficiency of the bow is determined in the usual fashion in that we look at the ratio of the energy coming out of the system divided by the energy that was put into the system. In this case we have the kinetic energy in the arrow at launch divided by the energy put into the bow by the archer prior to arrow launch. In this manner it is easily verifiable that bows in general can have efficiencies of nearly 90% when shooting very heavy mass weight arrows and the same bow can exhibit efficiencies in the lower 60 percentile when shooting very light mass weight arrows. The result is that a bow shooting heavy mass weight arrows imparts most of its stored energy to the arrow and after launch the bow must absorb only 10% of the original stored energy. On the other hand if the same bow were to shoot very light mass weight arrows it would have to absorb up to 40% of the original stored energy after each launch.

A number of the compound bows being offered today can store as much as 100 foot pounds of energy therefore it is conceivable that such a bow shooting a very light weight arrow could have to absorb up to almost 40 foot pounds of energy after each arrow launch. This excess energy trapped in the bow often results in a great deal of bow shock and vibration which is not only unpleasant to the archer but also takes its toll on the bows components and the accessories mounted to the bow.

Although some manufactures have tried to address the problem of this residual energy by using after market shock absorbing stabilizers and several patents have been issued for such devices (e.g. U.S. Pat. No. 5,016,602 and U.S. Pat. No. 5,411,009). These devices tend to be effective only along the axis on which they are mounted and the degree of damping that they provide is generally proportional to the amount of weight that they add to the system. The proposed damper is designed to be multi-axial in its ability to absorb and dissipate excess energy and in comparison it adds much less mass weight making it much more effective than previous dampers.

BRIEF SUMMARY OF THE INVENTION

The present invention is directed to a damper for reducing or dissipating energy. Specifically, the present invention addresses the problem of the excess energy that the bow is unable to transfer to the arrow during each shot by providing the bow with one or more energyabsorbing dampers. The present damper may be designed to fit into or be an integral part of a bow handle. The present damper may dissipate 20% or more of the excess energy created by the recoil of a the bow during and subsequent to shooting of the bow. This dissipation of energy reduces vibration making the shooting of the bow more pleasant and resulting in a quieter bow with less damage to bow components and accessories.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
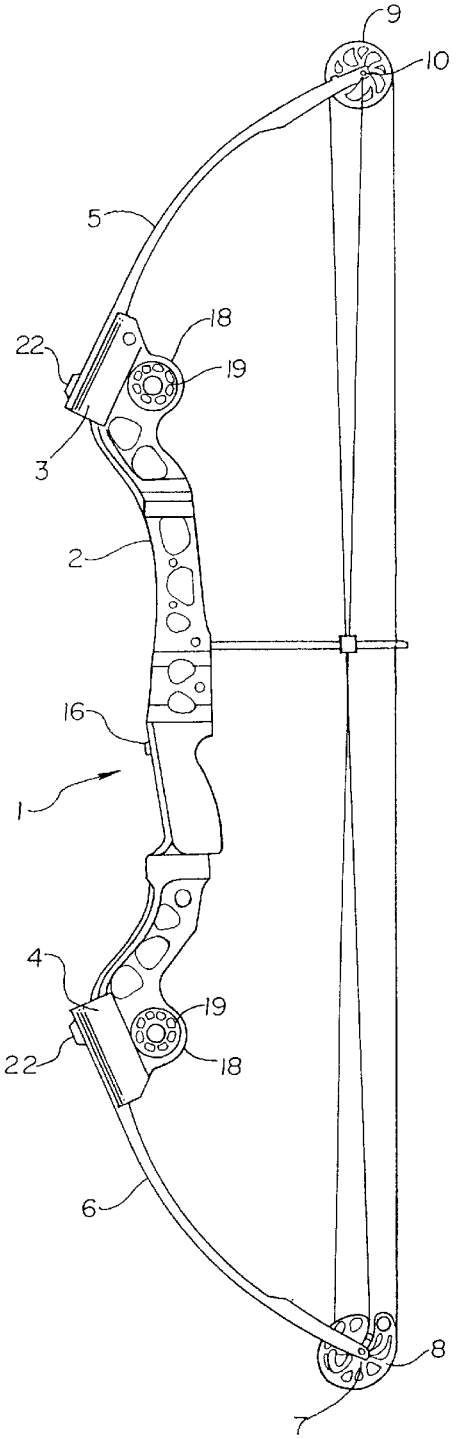
FIG. 1 is a side elevation view of a typical compound bow and illustrates one means of incorporating the incident invention into the bow handle of that bow.

Referring now to the drawings, FIG. 1 depicts a typical compound bow employing the latest technology including the innovative dampers which are the subject of this application. FIG. 1 is a side elevation view of the bow 1 having bow handle 2 to which are attached an upper limb 5 and lower limb 6. The upper and lower limbs are attached to the bow handle 2 using pivotal limb mounting cups 3 and 4 respectively. The bow depicted in FIG. 1 is referred to as a compound bow because located at the extremities of each bow limb are the components comprising a variable leverage system which allows the user to hold the bow at full draw while expending less effort than required with a traditional bow. A variable leverage device 8 is pivotally mounted on axle 7 at the free end of the lower limb 6 while an idler wheel 9 is pivotally mounted on axle 10 at the free end of the upper limb 5. This particular arrangement has become well known as, the dual feed-out single take-up, single cam system and was first disclosed in U.S. Pat. No. 5,368,006. While FIG. 1 depicts a compound bow of the single cam design the innovation which is the subject of this patent can be applied to compound bows of other designs as well as bows of traditional design. The bow handle 2 in FIG. 1 has been slightly modified at each end in the area behind the limb mounts 18 to make room for the damper assemblies 19 shown in FIG. 3.

Figure 2:
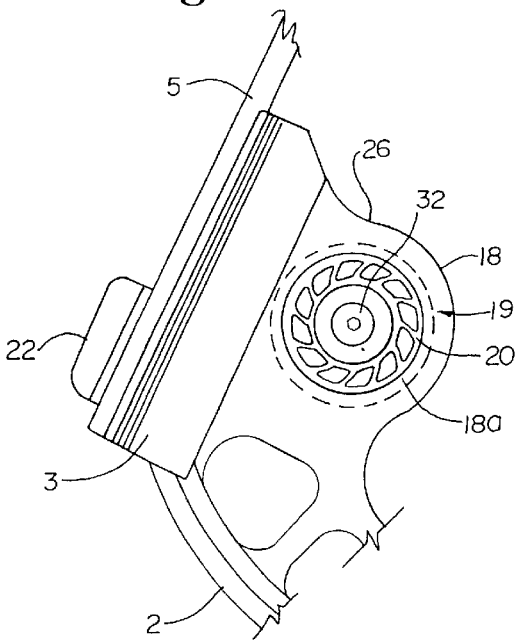
FIG. 2 is close up view of the upper portion of the bow handle as shown in FIG. 1 showing in more detail the location and mounting of the subject damping device.
Figure 3:
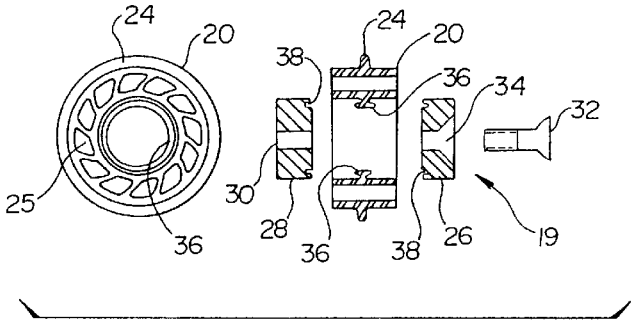
FIG. 3 shows a close up side elevation view of the damper assembly and also an exploded view of the components that comprise that assembly.

FIG. 2 is a close up view of the upper portion of the bow handle showing the damper 19 installed in area 18 of the handle. The resilient portion of the damper 20 has an external annular collar 24 best seen in FIG. 3 that mechanically retains the elastomeric portion of the damper in a corresponding groove 18*a* (FIG. 2)in the area 18 of the bow handle 2. In this case the elastomer is inserted into the opening in area 18 of the handle, and the two halves of the weight 26 and 28 are inserted into central opening such that the retaining grooves 38 on each weight half engages the mating portion 36 on the elastomer and the two halves are then secured together with capscrew 32. With the weight in place the elastomer is reinforced such that it is securely held in position mechanically. FIG. 3 shows an exploded view of the elastomer 20 and the components of the weight 26,28 and fastener 32.

Figure 4:
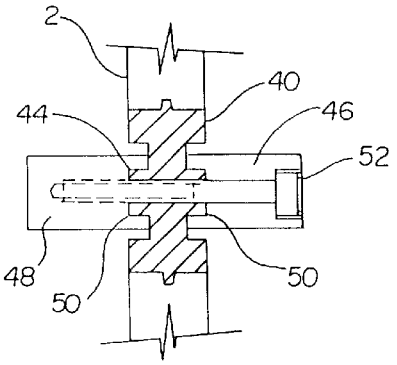
FIG. 4 is a section view through a portion of the bow handle showing a second configuration of the handle damper with a different weighting configuration.

The concept of inserting an elastomeric damper material into an opening in the bow handle and having that damper material affixed to an inertial mass can be accomplished effectively in a number of different ways. FIG. 4 shows a different shape of the elastomeric damper 40 and the in this case larger weights 46 and 48 are aligned to the damper material matching the annular projection of the damper material 44 with the annular grooves in the weights 50 and attached with capscrew 52.

Figure 5:
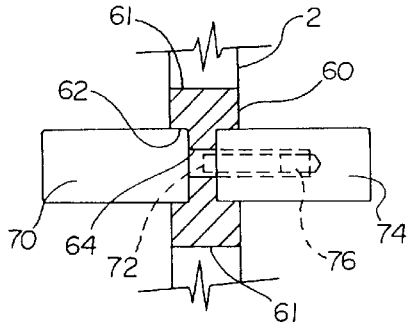
FIG. 5 shows a third section view illustrating another damper configuration having both a different elastomer mounting means as well as another weight mounting means.

FIG. 5 shows the damper material 60 which is adhesively bonded into the handle 2 at bond line 61 and the weight 70 has a male threaded portion 72 which engages the female threaded portion 76 of the second part of the inertial weight 74. The inertial weights 70 and 74 are located in a mated opening 62 in the damper material 60 and tightened securely against a portion of that material 64.

Figure 6:
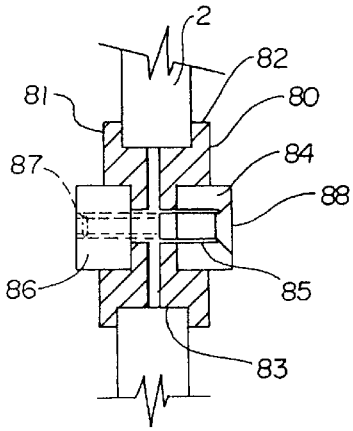
FIG. 6 is a cross section view of a fourth means of constructing and attaching the elastomer portion of the dampers.

FIG. 6 shows another arrangement where the damper is composed two halves 80 and 81 respectively. Each damper half has a portion 83 that fits closely into an opening in the handle for proper alignment additionally each half also has a flanged portion 82 which over laps said opening in the handle such that when the damper halves 80 and 81 are inserted into each side of the handle 2 and the corresponding weights 84,86 are inserted into pockets in the damper halves and drawn together with fastener 88 the complete damper assembly is held securely into the bow handle 2. Depending on how tightly the weights 84,86 are drawn into the damper material 80 one has a means to adjust the dampers response without having to make a damper material change.

Figure 7:
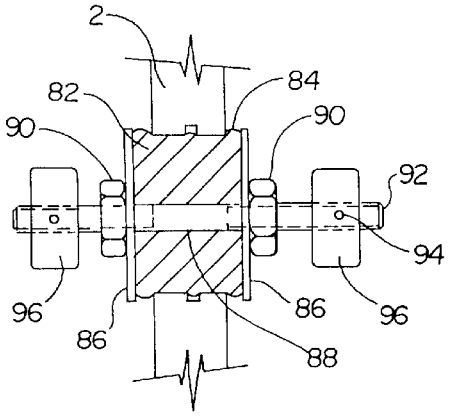
FIG. 7 is a cross section view of a damper arrangement that depicts a fifth means of securing the elastomeric portion of the damper to the bow as well as a variation in attaching the damper weights.

FIG. 7 shows a damper arrangement where the damper material fits into an opening in the bow handle with excess damper material exposed on each side of the handle. The exposed outer surfaces of the damper are engaged by compression plates 86 on both sides of the handle. The compression plates and the damper each have a central opening through which a threaded rod extends. Nuts are threaded on to each end of the threaded rod and engage the compression plates 86 as the nuts 90 are tightened the compression plates 86 apply pressure to the elastomeric damper material 82 causing it to deform 84 around the opening in the bow handle effectively locking the damper in place in the handle 2. Another aspect of this arrangement is that the response of the damping material can also be adjusted by controlling the pressure that the compression plates 86 apply against the damper material 82. An additional feature of this arrangement is that the mass weights 96 can be variably positioned on either side of mounting rod 92 and locked in position using set-screws 94 giving another dimension of adjustability.

Figure 8:
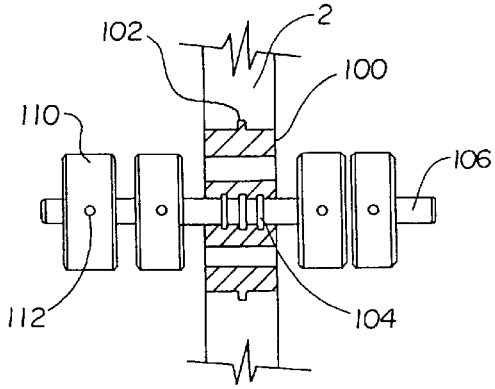
FIG. 8 is another cross section view depicting still another means of attaching the weight assembly to the elastomer portion of the damper and also illustrates another weighting configuration.

FIG. 8 shows still another arrangement of the damper assembly. In this arrangement the weight supporting rod 106 is attached directly to the damper material 100 either adhesively or as shown here the rod may be designed to be vulcanized, cast, or injection molded 104 into the damper material. This arrangement also shows the versatility that can be achieved in both the amount of weight units 110 and the positioning of the weight to be used. Weights 110 can be located in various positions on rod 106 and secured into position with setscrews 112.

The dampers shown in FIG. 1, FIG. 2, and FIG. 3 are circular in design for several reasons, the circular design is equally responsive in all radial directions in solid or with symmetrically designed openings in the dampers resulting in the ability to absorb energy in a multitude of directions. While the circular design has some obvious manufacturing benefits the dampers could be manufactured in other shapes and be installed in other areas of the bow handle with varying degrees of effectiveness depending on the location chosen and the particular damper design. The effectiveness of dampers as disclosed herein also depends on the damping coefficient of the material chosen the durometer of that material and the final geometry of the damper as well as the configuration and density of the weights attached to the damping material. Dampers of the configuration shown in FIG. 3 were tested using various materials and material compositions for the elastomer portion 20. Amongst the materials first tested were Anyln ™ and Santoprene ™ both in several different durometers (hardness) which gave the indication that the concept could provide the desired effect of making a significant reduction in the shock, vibration and a reduction in the total energy that reaches the users bow hand. The results with the materials used to date also indicates that the dampers performance can be tailored to a given weight range of arrows to be shot and a damper material that performs exceptionally well with light weight arrows may not give the best results when shooting heavier weight arrows.

Figure 9:
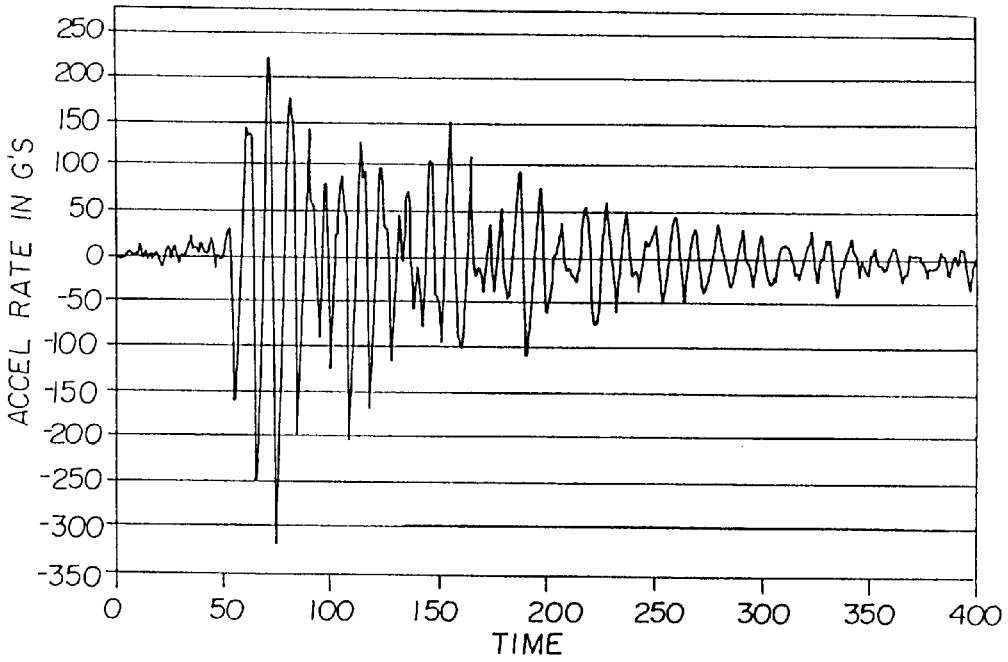
Fig. 9 PRIOR ART
FIG. 9 is a graph showing the acceleration rate of the bow handle in the area of the small of the grip when the bow shoots an arrow weighing 6.2 grains per peak pound of bow draw weight and there are no dampers in the bow handle.
Figure 10:
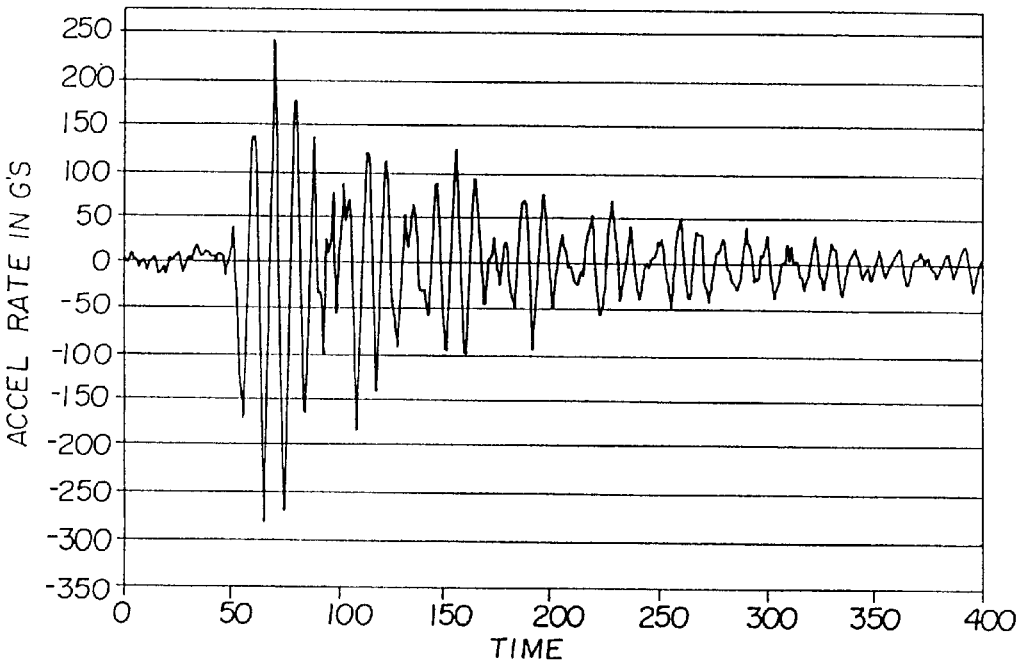
FIG. 10 is a graph showing the acceleration rate of the bow handle under the same conditions as represented in FIG. 9 except that the bow handle had dampers installed.
Figure 11:
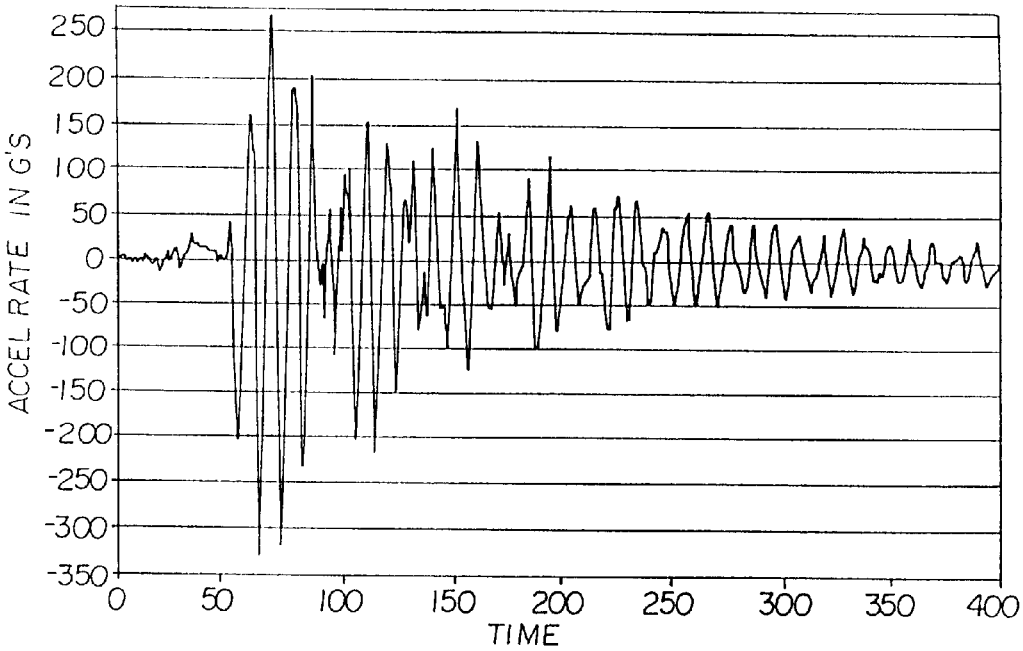
Fig. 11 PRIOR ART
FIG. 11 is a graph showing the acceleration rate of the bow handle in the area of the small of the grip when the bow shoots an arrow weighing 5.5 grains per peak pound of bow draw weight and there are no dampers in the bow handle.
Figure 12:
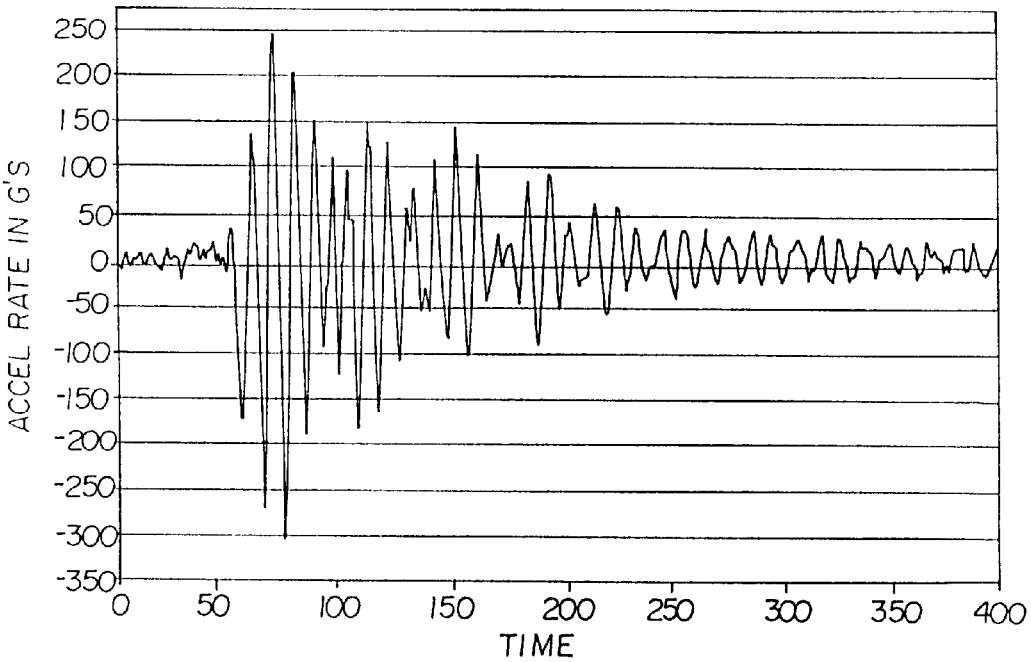
FIG. 12 is a graph showing the acceleration rate of the bow handle when the bow is set-up and shot under the same conditions as represented in FIG. 11 with the exception being that the bow handle was equipped with dampers.

The test bow as shown in FIG. 1 was fitted with an accelerometer 16 located on the back of the handle directly across from the low point in the bows grip. The accelerometer 16 was positioned so as to detect the acceleration rate of the handle in this area in the direction parallel to the arrows launch path. That signal was sent to a Tektronix™ 336 digital storage oscilloscope and then down loaded to a personal computer. Some of the test results are shown here in FIG. 9 thru FIG. 14. FIG. 9 shows the acceleration rate at the grip versus time plot when the bow is shot with a 431 grain arrow and no dampers installed and FIG. 10 shows the same bow set-up with a specific damper installed and shooting the 431 grain arrow. Analysis of these two graphs shows that the average shock force at the bow hand was reduced by 7% while the peak shock forces were reduced by 5%. FIG. 11 shows the results of shooting the same 30" draw, 70# peak weight bow with out dampers and shooting a 385 grain arrow. FIG. 11 should be compared with the chart of FIG. 12 which shows the bows response with dampers installed and shooting the same 385 grain arrow. Analysis of these two graphs indicates that the addition of the dampers resulted in a 13.5 to 15% reduction in the average shock force reaching the archers hand and nearly a 20% reduction in the average Peak shock forces at the archers bow hand. These were rather unexpected results in that most after market shock absorbing stabilizers add considerably more mass to the system and result in providing no more damping effect and in many cases they have less damping effect on the forces and energy reaching the archers bow hand. It can also be shown from the graphs of FIGS. 11 and 12 that when the bow is equipped with dampers the total energy that the bow hand is exposed to is reduced by 10%.

Figure 13:
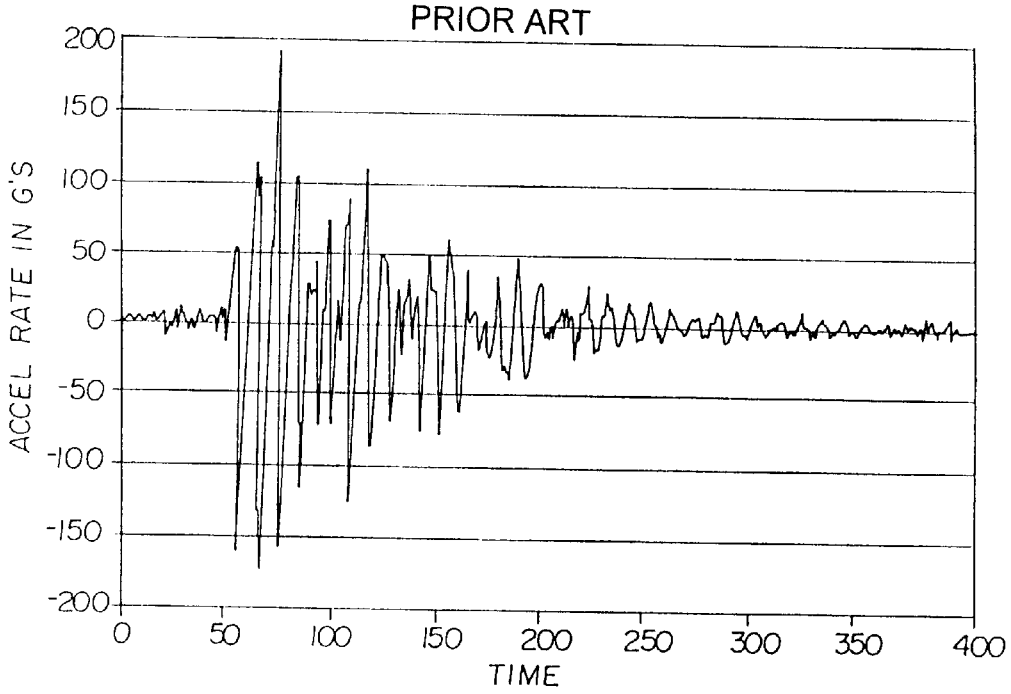
FIG. 13 is a graph showing the acceleration rate of the bow handle in the area of the small of the grip when the handle without the dampers installed is suspended from one end and receives a given impact at the opposite end of the handle.
Figure 14:
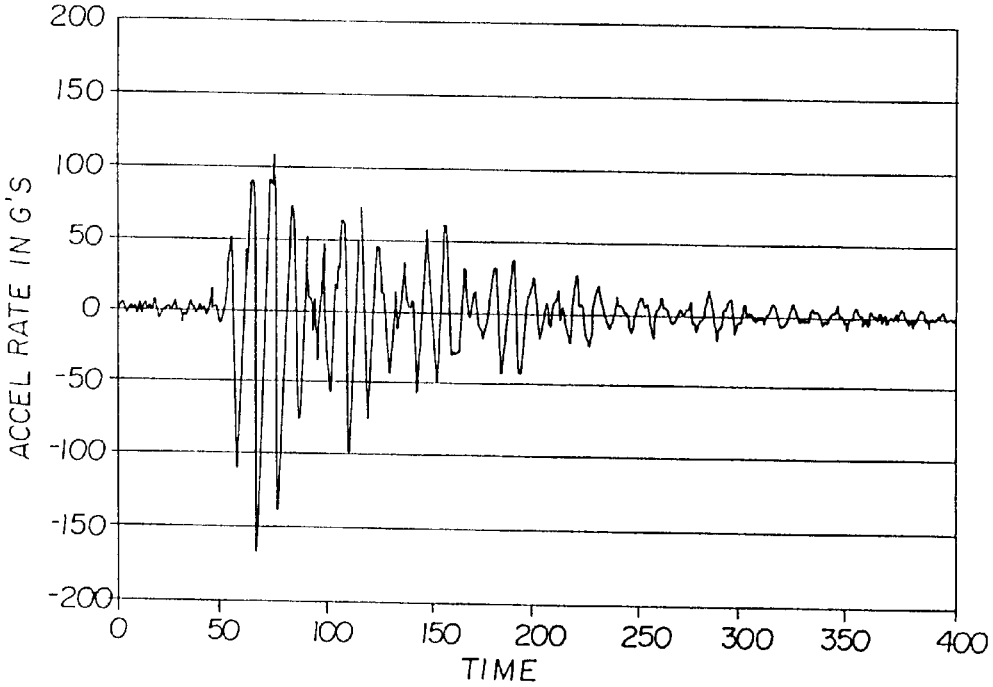
FIG. 14 is a graph showing he acceleration rate of the same set-up and impact conditions as in FIG. 13 except that for this test the handle had the dampers installed.

A second benefit of the dampers is the effect that they have on the secondary ringing vibrations that can occur in the handle when the arrow is shot. This is the same type of effect that occurs when such items as baseball bats, tennis rackets, hammers etc. are subjected to sudden load application or impact. The resulting ringing or stinging vibrations that can occur are less than pleasurable and can effect the users performance. To test the effectiveness of the handle dampers on this type of vibrations the bow handle 2 was disassembled from the bow and freely suspended from one end with the accelerometer 16 attached as described earlier. The handle was then impacted identically with and without the dampers installed. FIG. 13 is the graph of the bow handles response when the dampers were removed and FIG. 14 is the response of the handle with the dampers in place. Comparing the graphs, one finds that the handle with dampers has a reduction of 20% in the magnitude of the peak acceleration forces over the first 75 milliseconds after impact and the time required for the major vibrations to dampen out was reduced by a factor of 3.5 to 5.5 depending on the specific damper configuration and damper material used.

The invention may be embodied in many forms without departing from the spirit or the essential characteristics of the invention. For example, a number of variations on the configuration of the elastomeric portion of the damper and the means of attaching that portion to the bow handle along with several different weighting concepts and means of attachment of those weights to the elastomeric portion have been disclosed but they do not by any means cover the full scope of the invention. The present embodiments are therefore to be considered in all respects as illustrative and not restrictive. The scope of the invention is indicated by the appended claims rather than by the foregoing description. All changes that come within the meaning and range of equivalency of the claims are intended to be embraced therein.

In addition to being directed to the embodiments described above and claimed below, the present invention is further directed to embodiments having different combinations of the features described above and claimed below. As such, the invention is also directed to other embodiments having any other possible combination of the dependent features claimed below.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A dampening device for use with an archery bow, the dampening device absorbing vibrational energy which results from shooting an arrow from the bow, the dampening device comprising at least one resilient member and at least one counterweight, the at least one resilient member including an external collar and one or more weight mating portions, the external collar constructed and arranged to engage a dampening device receiving region of a bow, the one or more weight mating portions constructed and arranged to receivably engage at least a portion of the at least one counterweight.

2. The dampening device of claim 1 wherein the resilient member is elastic.

3. The dampening device of claim 1 wherein the resilient member is constructed at least partially from rubber.

4. The dampening device of claim 1 wherein the external collar is adhesively bonded to the dampening device receiving region.

5. The dampening device of claim 1 wherein the external collar is frictionally engaged to the dampening device receiving region.

6. The dampening device of claim 1 wherein the dampening device receiving region comprises a receiving groove, the external collar is frictionally engaged to the receiving groove.

7. The dampening device of claim 1 wherein the at least one counterweight comprises a first weighted portion and a second weighted portion, the first weighted portion received by and retainingly engaged to the one or more weight mating portions, the second weighted portion received by and retainingly engaged to the one or more weight mating portions.

8. The dampening device of claim 7, further comprising a weight retaining member, the first weighted portion and the second weighted portion each having a receiving hole therethrough for receiving the weight retaining member, the weight retaining member engaging the receiving hole of the first weighted portion and the second weighted portion.

9. The dampening device of claim 8 wherein the weight retaining member is a fastener, the fastener passing through and being retained by the receiving holes of the first weighted portion and the second weighted portion.

10. The dampening device of claim 8 wherein the first weighted portion and the weight retaining member are integral, the second weighted portion having a receiving hole for removably receiving and engaging the weight retaining member.

11. The dampening device of claim 8 wherein the weight retaining member is a screw, the receiving holes of the weighted portions being threaded, the screw threadingly engaged to the receiving holes of the weighted portions.

12. The dampening device of claim 8 wherein the first weighted portion and the weight retaining member are integral, the weight retaining member characterized as a screw, the second weighted portion having a threaded receiving hole for removably receiving and threadingly engaging the weight retaining member.

13. The dampening device of claim 7, the one or more weight mating portions further including one or more protrusions, the one or more protrusions frictionally engaged to the first weighted portion and the second weighted portion.

14. The dampening device of claim 1, the dampening device having an ellipsoid shape.

15. The dampening device of claim 14 wherein the external collar comprises an annular ring.

16. A combination archery bow and dampening device system for absorbing vibrational energy comprising:

an archery bow having one or more dampening device receiving regions;

one or more dampening devices, the one or more dampening devices having at least one resilient portion and at least one weight, the at least one resilient portion including an annular mating ring which receivably engages the one or more dampening device receiving regions, the at least one resilient portion further including one or more weight mating portions, the one or more weight mating portions constructed and arranged to engage at least a portion of the at least one weight.

17. The combination archery bow and dampening device system for absorbing vibrational energy of claim 16 wherein the at least one weight comprises a weight retaining member engaged to the one or more weight mating portions and a plurality of weighted portions disposed about the weight retaining member.

* * * * *